US006461283B1

(12) United States Patent
Maron

(10) Patent No.: US 6,461,283 B1
(45) Date of Patent: Oct. 8, 2002

(54) PLYOMETRIC EXERCISE APPARATUS

(76) Inventor: Barry R. Maron, 7125 Ticonderoga Rd., NE., Albuquerque, NM (US) 87109

( * ) Notice: Subject to any disclaimer, the term of this patent is extended or adjusted under 35 U.S.C. 154(b) by 13 days.

(21) Appl. No.: 09/792,750

(22) Filed: Feb. 23, 2001

(51) Int. Cl.[7] ..... A63B 21/02
(52) U.S. Cl. ..... 482/123; 482/124; 482/129
(58) Field of Search ..... 482/123, 120–130, 482/148, 93–94, 133–138, 142, 102–103; 297/93, 284, 280, 14–15, DIG. 3, 468, 469, 417, 464, 466, 485; 272/134–137, 144, 142; D21/687; 108/81, 38

(56) References Cited

U.S. PATENT DOCUMENTS

| | | | | |
|---|---|---|---|---|
| 217,918 A | | 7/1879 | White | |
| 1,548,849 A | * | 8/1925 | Ruden | 272/93 |
| 1,969,901 A | | 8/1934 | Pilates | |
| 3,813,148 A | * | 5/1974 | Kraus | 297/231 |
| 3,888,481 A | | 6/1975 | Adams, Jr. et al. | |
| 4,087,127 A | * | 5/1978 | Lotta | 297/14 |
| 4,460,171 A | | 7/1984 | Plyhm | |
| 4,759,543 A | * | 7/1988 | Feldman | 272/93 |
| 4,819,278 A | * | 4/1989 | Ramos | 4/254 |
| 4,913,423 A | | 4/1990 | Farran et al. | |
| 5,050,875 A | * | 9/1991 | Lewkovich | 272/137 |
| 5,110,121 A | | 5/1992 | Foster | |
| 5,141,482 A | | 8/1992 | Hern | |
| 5,599,261 A | | 2/1997 | Easley et al. | |
| 5,624,361 A | | 4/1997 | Lai | |
| 6,013,014 A | | 1/2000 | Hern | |
| 6,063,012 A | | 5/2000 | Berkowitz et al. | |

OTHER PUBLICATIONS

Chu, D., PhD., "Plyometrics: The Link Between Strength and Speed", *National Strength and Conditioning Ass'n Journal*, Apr.–May 1984, pp. 20–21.

Costello, Fr., "Using weight training and plyometrics to increase explosive power for football", *National Strength and Conditioning Ass'n Journal*, Apr.–May, 1984, pp. 22–25.

Radcliffe, J.C., et al., *Plyometrics: Explosive Power Training*, 1985, Human Kinetics Publishers, Champaign, Illinois.

* cited by examiner

*Primary Examiner*—Michael A. Brown
*Assistant Examiner*—Lori Baker Amerson
(74) *Attorney, Agent, or Firm*—Rod D. Baker

(57) ABSTRACT

An apparatus for plyometrically exercising the muscles of the user's back. The apparatus includes a exercise panel connected parallel to a back panel, the exercise panel being movable in relation to the back panel. Springs are disposed between the exercise panel and the back panel, so that movement of the exercise panel in relation to the back panel requires compression or extension of the springs. A seat panel is provided, which is connected to the back panel and when in use is disposed about perpendicular to the back panel. Body straps are provided for comfortably securing the user's torso to the exercise panel. The user plyometrically exercises his back muscles by rapidly alternately pressing his back against the exercise panel to compress the springs, and then pushing forward against the body straps to pull the springs into tension.

21 Claims, 4 Drawing Sheets

PLYOMETRIC EXERCISE APPARATUS

BACKGROUND OF THE INVENTION

1. Field of the Invention (Technical Field)

The present invention relates to exercise apparatuses, particularly plyometric exercise apparatuses, and specifically an apparatus for plyometrically exercising the muscles of the back, most notably the muscles of the lower back.

2. Background Art

For centuries, athletes have pursued techniques for improving body strength and quickness. Strength combined with speed results in power, and physical power is a principal goal of any athlete, regardless of the sport or game of interest. Strength conditioning (for example, many types of weight lifting) has been practiced since time immemorial. Exercises for improving speed and quickness have been practiced at least as long. Many "speed" exercises focus on the performance of exercises designed to enhance quick, explosive movements. However, only in the past thirty years or so has a training system emerged which emphasizes "explosive-reactive" power development. This comparatively modem athletic training system for boosting explosive-reactive power is known as "plyometrics."

Generally, "plyometrics" refers to exercises characterized by powerful muscular contractions in response to rapid, dynamic loading or stretching of the involved muscles. Examples of plyometric movements include the sprinter launching from her starting blocks, a volleyball player leaping for the ball, the long jumper at the instant of take-off, the golfer during his swing, or the basketball player jumping for a rebound. Indeed, most sports involve movement requiring explosive bursts of effort, and participants in training can benefit greatly from plyometric exercise.

An excellent and comprehensive, yet manageably succinct, overview of plyometric exercise is provided by James Radcliffe and Robert Farentinos, in their book *Plyometrics: Explosive Power Training* (Human Kinetics Publishers, Champaign Ill.), the entire disclosure of which is incorporated herein by reference. According to Radcliffe and Farentinos, modem plyometrics originated with training exercises developed by athletic coaches in the former U.S.S.R. and Warsaw Pact nations of the mid-1960s. An early proponent of plyometrics was Yuri Veroshanski, the Russian coach whose remarkably successful training of jumpers is universally acknowledged. Veroshanski emphasized depth jumps as a valuable plyometric exercise, and an central aspect of his conceptualization of plyometrics was his assertion that plyometric training promoted development of the entire neuromuscular system for power movements, not merely the contractile tissue alone.

The "stretch reflex", also referred to as the muscle spindle reflex or myotactic reflex, is the basis of the motor processes involved in plyometrics. The stretch reflex is an essential process in the nervous system's overall control of body movement. In many skilled athletic maneuvers immediately preceding an explosive-reactive movement, the muscles may undergo a rapid stretching, resulting from muscle loading. As explained by Radcliffe and Farentinos, this stretching has been referred to as the "cocking phase," and occurs in such movements as the swing of a tennis racket or baseball bat. Unbeknownst (usually) to the athlete, during such a cocking phase the muscle fibers in the muscle groups responsible for the swing's power are rapidly but slightly lengthened in anticipation of the swing. This rapid stretching of the muscles activates the muscle spindle reflex, which in turn sends a strong stimulus via the spinal cord to the muscles, causing them powerfully to contract.

For example, when a right-handed golfer begins her back swing, the bicep muscle of the left arm contracts and the tricep is stretched. When the golfer begins the forward swing, the tricep contracts powerfully in response to its rapid stretching which activated the muscle spindle reflex. According to Radcliffe and Farentinos, various terms have been suggested to describe phases of this phase reflex. The rapid loading of the muscle fibers immediately prior to muscle contraction has been called the "eccentric" or "yielding" phase, the brief period of time between initiation of the eccentric phase and the reflex muscle contraction has been dubbed the "amortization" or "overcoming" phase, and the contraction itself is the "concentric phase." It is believed that plyometric exercises promote various changes in the neuromuscular system, enhancing the ability of the muscle groups to respond more quickly and powerfully to slight and rapid changes in muscle length. An important feature of plyometric training evidently is the conditioning of the neuromuscular system to allow for faster and more powerful changes of direction, for example, going from down to up in jumping, or in moving the legs first forward and then backward while running. Reducing the time needed for this change in direction increases speed and power.

Much of plyometric training can be accomplished without the use of any exercises devices, such as through specially developed jumping, stepping, and hopping exercises. Others involve particularized uses of poles or weights, or controlled falling from specialized platforms. These exercises and aid devices commonly are used for plyometrically training the muscles of the limbs and abdomen.

Additional information about plyometric exercise can be found in Chu, D., National *Strength and Conditioning Ass'n Journal*, April-May 1984, pp. 20–25.

It is known, however, that properly exercising the muscles of the back can alleviate lower back pain. An aspect of the invention of the present invention is the determination that back muscle conditioning, and its role in back pain therapy, should be extended to include plyometric exercise. A need results for an apparatus adapted to permit the user to plyometrically exercise the muscles of the back, including the lower back. The disciplined use of such an apparatus, particularly with the assistance and supervision of a trained physician or therapist, may provide beneficial relief from lower back pain. The present invention fills this need.

SUMMARY OF THE INVENTION (DISCLOSURE OF THE INVENTION)

An apparatus for plyometrically exercising the muscles of the user's back. The apparatus includes a exercise panel connected parallel to a back panel, the exercise panel being movable in relation to the back panel. Springs are disposed between the exercise panel and the back panel, so that movement of the exercise panel in relation to the back panel requires compression or extension of the springs. A seat panel is provided, which is connected to the back panel and when in use is disposed about perpendicular to the back panel. Body straps are provided for comfortably securing the user's torso to the exercise panel. The user plyometrically exercises his back muscles by rapidly alternately pressing his back against the exercise panel to compress the springs, and then pushing forward against the body straps to pull the springs into tension and resist forward motion. Features are disclosed for enhancing the portability of the apparatus, and for removably attaching it to an ordinary chair when in use.

There is provided according to the invention an apparatus for plyometrically exercising the muscles of the user's back.

The apparatus features a rigid seat panel, a rigid back panel connected to the seat panel and disposable approximately perpendicular to the seat panel, an exercise panel disposed generally parallel to the back panel, one or more springs for movably connecting the exercise panel to the back panel, and at least one body strap connected to the exercise panel. By this assembly, the user may sit upon the seat panel with the user's back in contact with the exercise panel and with the at least one body strap disposed around the torso of the user, and repeatedly and alternately first push against the exercise panel and the force of the springs, and then push against the at least one body strap and the force of the springs, and thus plyometrically exercise the muscles of her back.

The apparatus preferably also has a seat pad upon the seat panel and a back pad upon the exercise panel for the user's comfort during use.

Preferably, the seat panel is pivotally connected to the back panel, such as by a hinge, whereby the seat panel is pivotal between a use position approximately perpendicular to the back panel and a storage position approximately parallel to the back panel.

The springs preferably are one or more helical coil spring mounted between the back panel and the exercise panel, and preferably are disposed symmetrically about the centroids of the back and exercise panels.

There is provided in the preferred embodiment means for adjusting the compression of the springs. This adjustment means may feature at least one threaded adjustment bolt mounted upon the exercise panel and extending through the back panel, and an adjustment knob screwably engaged to the at least one threaded adjustment bolt and contactable with the back panel, wherein rotation of the knob moves the back panel to vary the distance between the back panel and the exercise panel thereby to adjust the compression of the at least one coil spring.

The inventive apparatus preferably further includes at least one back attachment strap connected to the back panel, and the back attachment strap is removably engageable around the back of a chair to secure the back panel to the chair. Likewise, there ideally is provided at least one seat attachment strap connected to the seat panel, so that the seat attachment strap is removably engageable around the seat of a chair to secure the seat panel to the chair.

Notably, the seat panel is pivotal between a use position approximately perpendicular to the back panel and a storage position approximately parallel to the back panel, and when the seat panel is in the stored position, the back attachment strap is engageable around the seat panel, and the seat attachment strap is engageable around the back panel, thereby to hold the seat panel in the stored position.

The body straps preferably are a pair of shoulder straps, each of the straps having an upper end removably attachable to an upper portion of the exercise panel and a lower end removably attachable to a lower portion of the exercise panel, and a pair of chest straps, each of the straps having an upper end removably attachable to an upper portion of the exercise panel and a lower end removably attachable to a lower portion of the exercise panel.

A primary object of the present invention is to provide an apparatus for plyometrically exercising the muscles of the back, particularly the lower back.

Primary advantages of the present invention are that it is inexpensive to manufacture and maintain, and simple and safe to use.

Another advantage of the preferred embodiment of the apparatus of the invention is that it is portable and easily stored when not in use.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention.

The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT THE INVENTION)

The invention is an exercise apparatus for use in plyometrically exercising the muscles of the user's back. The preferred embodiment is portable, allowing it to be folded into a collapsed position for convenient storage and transportation. Further, the preferred embodiment is removably attachable to a conventional chair, for secure disposition during use. It will be immediately understood by one of skill in the art, however, that alternative embodiments of the invention need not be foldable into a collapsed storage position, and that embodiments of the invention may be permanent fixtures upon a specially configured exercise chair.

Figure 1:
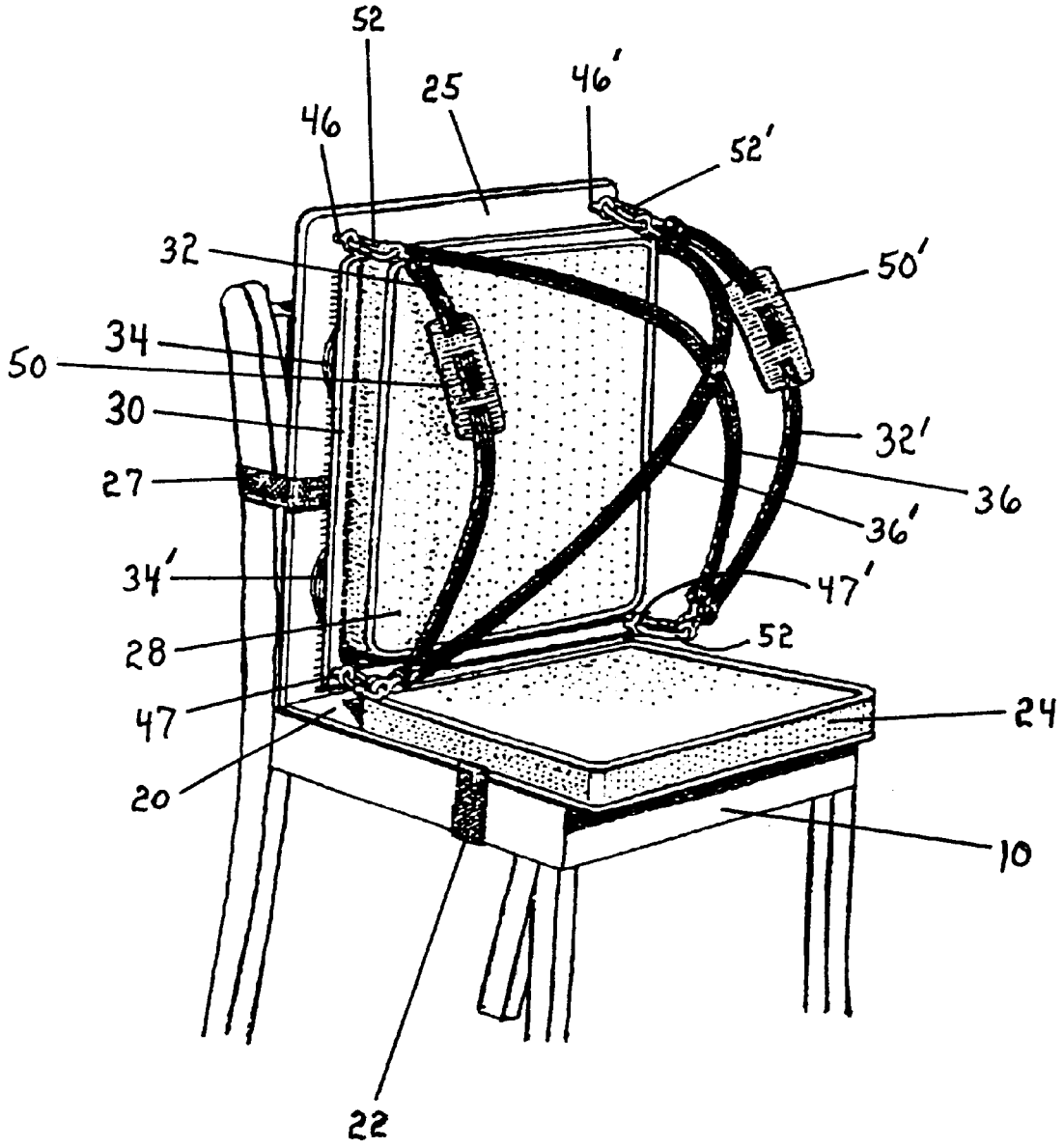
FIG. 1 is a front perspective view of a preferred embodiment of the apparatus of the invention, shown disposed upon a conventional chair.

FIG. 1 offers a general view of the invention removably attached to a conventional chair. The apparatus can conceivably be used on nearly any ordinary four-legged chair, although a plain, unpadded, standard wooden framed chair 10 as seen in FIG. 1 serves well. The apparatus includes as principal elements a rigid seat panel 20, a rigid back panel 25, an exercise panel 30 situated generally parallel to the back panel, and at least one and preferably a plurality of springs 34, 34' movably connecting the exercise panel to the back panel. The seat panel 20, back panel 25, and exercise panel 30 are fashioned from any durable, lightweight material, such as plastic, fiberglass, epoxy composite, or wood, so that these panels resist significant bending and may serve as anchor surfaces for fasteners such as screws or rivets. The panels 20, 25, 30 are depicted in FIG. 1 as being planar and square; in alternative embodiments, the back, seat, and exercise panels are planar, but may have other perimeter shapes such as rectangles or other polygons, or ovals. It is preferred that all three panels have the same general perimeter shape, although it is noted that they need not be the same size, and indeed the exercise panel 30 preferably is slightly smaller than the back panel 25. The seat panel 20 preferably is pivotally connected to the back panel 25 by a hinge (not seen in FIG. 1) in a manner to be further described, to foster the portability of the complete apparatus.

Continued reference to FIG. 1 shows that the apparatus also is provided with at least one seat attachment strap 22 for temporarily securing the seat panel 20 to the seat of the chair 10, and at least one back attachment strap 27 used to temporarily secure the back panel 25 to the back of the chair 10. The flexible back attachment strap 27 has two separate segments, each having an end permanently attached to a side edge of the back panel 25. The segments of the back attachment strap can be adjustably connected by means of a buckle 38, cam buckle, VELCRO® fasteners or the like. Likewise, a flexible seat attachment strap 22 has two segments connectable by an adjustable fastener, such as a buckle 39. Accordingly, the apparatus can be attached to chairs of various widths.

A pair of flexible shoulder straps 32, 32' are releasably anchored at their lower ends to the lower portion of the exercise panel 30, and at their upper ends to the upper portion of the back panel 25, as seen in FIG. 1. A pair of "crossed" chest straps 36, 36' are similarly releasably attached to the exercise panel 30 and back panel 25. Preferably, but optionally, a back pad 28 of modest thickness is secured to the back panel 25 for the comfort of the user, and a similar seat pad 24 may be secured to the seat panel 20 to cushion the user's buttocks during the practice of the invention.

The overall main function of the invention is to allow the user to exercise the muscles of the back, particularly the lower back, plyometrically. This is accomplished by the user's alternatively pressing the exercise panel 30 toward the back panel 25 and pulling the exercise panel away from the back panel, against the compression or tension of the springs 34, 34', in a manner to be described further.

Figure 6A:
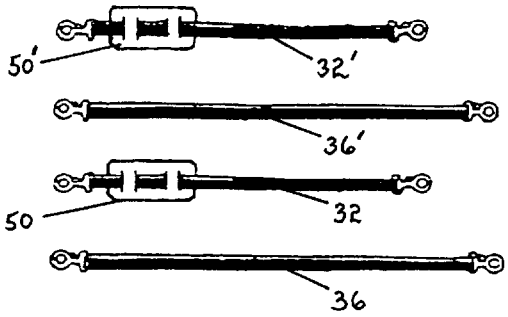
FIG. 6A is a reduced view of the collection of strap elements of the preferred embodiment of the invention.

FIG. 6A is a view reduced in scale of the shoulder straps 32, 32' and the chest straps 36, 36' according to the invention. The chest straps 36, 36' are of generally the same construction and dimensions as the shoulder straps 32, 32', except that the chest straps are somewhat (e.g., about 15%) longer. These straps may be fashioned from rubber, leather, nylon strapping, or any other durable and flexible strap material. Preferably, the shoulder and chest straps 32, 32', 36, 36' are fashioned from a material that does not undergo significant axial stretching or elongation when loaded in tension. The shoulder straps 32, 32' preferably but optionally are provided with comfort cushions 50, 50' of known construction, whose positions along the shoulder straps are slidably adjustable to suit the user.

Figure 6B:
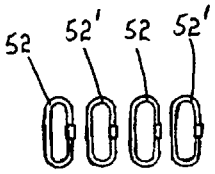
FIG. 6B is an enlarged view of the collection of strap clip elements of the apparatus.

The straps 32, 32', 36, 36' are removably attachable to the back panel 25 and the exercise panel 30 by means of releasable strap clips 52, 52', as shown in FIG. 6B. The strap clips preferably are small metal loops with gates therein that may be opened and closed, similar to carabiner clips commonly employed in the field of mountaineering and rock climbing. Releasable strap clips 52, 52' are engageable through loops permanently attached to the ends of the straps 32, 32', 36, 36' (FIG. 6A), to permit the straps to be releasably connected to loop anchors permanently affixed at the upper attachment points 46, 46' and lower attachment points 47, 47' upon the back and exercise panels 25, 30.

Figure 2:
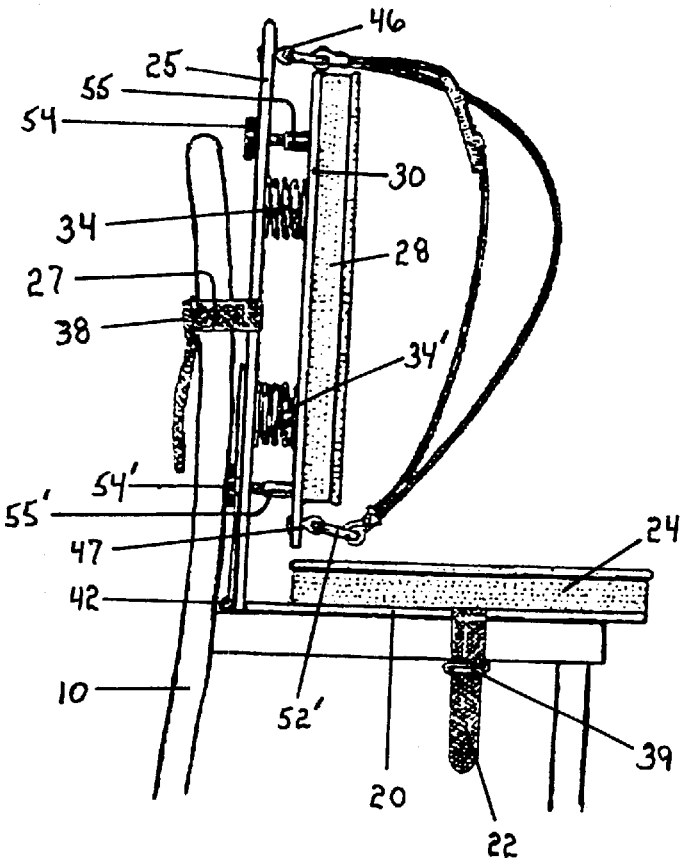
FIG. 2 is a right side view of the embodiment of the invention seen in FIG. 1.

FIGS. 1 and 2 show the straps 32, 32', 36, 36' as they are positioned when the apparatus of the invention is in use. One shoulder strap 32 is releasably connected to extend between the right upper attachment point 46 (on the back panel 25) and the right lower attachment point 47 (on the exercise panel 30), while the other shoulder strap 32' extends between the left upper attachment point 46' (again, on the back panel) and the left lower attachment point 47'. The chest straps 36, 36' are arranged in a cris-cross manner, with one strap 36 extending between the right upper attachment point 46 and the left lower attachment point 47, and the other 36' extending from the left upper attachment point 46' over and down to the right lower attachment point.

Figure 3:
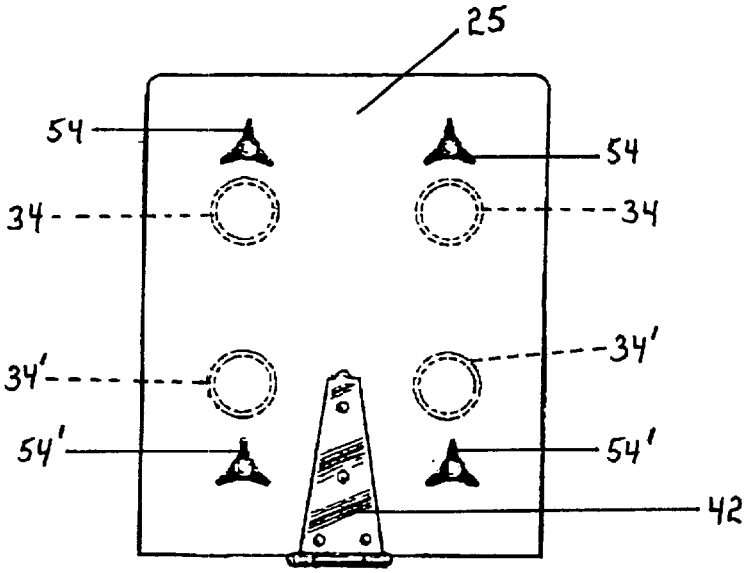
FIG. 3 is a rear view of a preferred embodiment of the invention.
Figure 4:
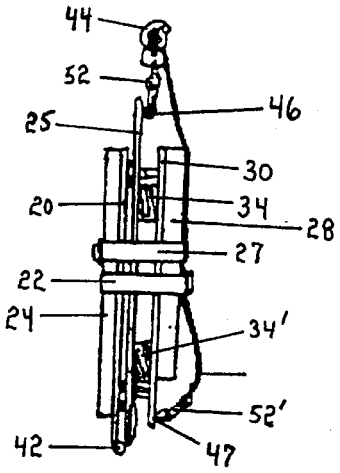
FIG. 4 is a reduced side view of the apparatus of the invention, shown in the collapsed storage position.

FIGS. 2 and 3 illustrate that the back panel 25 and the seat panel 20 are pivotally connected by a hinge 42 having one leaf permanently fixed to the back panel and the other leaf permanently attached to the seat panel, as with screws, rivets or the like. The hinge 42 permits the back panel 25 to be pivoted from the position seen in FIG. 2, i.e., approximately perpendicular to the seat panel 20, to a collapsed position approximately parallel to the seat panel, as seen in FIG. 4. Illustrated is a large conventional pin-and-knuckle hinge, although nearly any other type of hinge, for example a piano hinge, or fabric or plastic or other flexible "living" hinge, is within the scope of the invention.

The exercise panel 30 is connected to the back panel 25 by one or more springs 34, 34'. An embodiment of the invention conceivably could include a single spring centrally located between the exercise and back panels (i.e. generally equidistant from the edges of each panel), but in the preferred embodiment of the invention are a plurality, for example four, springs 34, 34', symmetrically arranged around the centers of the panels 25, 30. FIG. 3 shows that a pair of upper springs 34 and a pair of lower springs 34' are symmetrically arranged around the centroids of the panels 25, 30. In the preferred embodiment, the centroids of the panels 25, 30 define an imaginary line that is normal to the panels, and the exercise panel 30 is somewhat smaller in size than the back panel 25.

The springs 34, 34' are shown to be and preferably are conventional helical coil springs, but alternative embodiments may employ leaf springs or other resiliently elastic spring elements. The springs 34, 34' connect the back panel 25 and exercise panel 30, and hold them apart in spaced relation. The exercise panel 30 preferably is at all time generally parallel to the back panel 25, and is movable with respect thereto by the compression or extension of the springs 34, 34'. Movement of the exercise panel 30 from its neutral (at-rest) position toward the back panel 25 compresses the springs 34, 34' ; the further such movement progresses, the greater the force (according to the spring constant k) with which the springs urge the exercise panel away from the back panel, according to convention. Conversely, moving the exercise panel 30 away from the back panel 25 past the neutral position of the springs 34, 34' results in the extension of the springs, with the result that the springs tend to pull the exercise panel 30 back toward the back panel as the springs rebound toward their neutral position.

The amount of "play" or "travel" in the springs 34, 34' is selectively adjustable by means of a plurality of threaded adjustment bolts 55, 55' extending between the exercise panel 30 and the back panel 25, as best seen in FIGS. 2 and 3. The bolts 55, 55' are affixed to the exercise panel 30, but pass through the back panel 25. Adjustment handles 54, 54', which may be accompanied by washers of suitable diameter, press against the back panel 25. By controlled rotation of the threaded adjustment handles 54, 54', which serve as movable "nuts" upon the bolts 55, 55', the user can adjust the distance between the panels 25, 30 and thus the compression in the springs 34, 34'. By rotating the handles 54, 54' clockwise (FIG. 3), for example, the handles "tighten" upon the bolts 55, 55', and draw the exercise panel 30 closer to the back panel 25. This compresses the springs 34, 34', with the result that the force required to further incrementally compress the springs is increased, and the springs are "stiffer". The stiffer compressed springs offer more resistance to further compression, and thus provide a greater "workout" to the user practicing the invention. Conversely, the handles 54, 54' may be counter-rotated to relax the springs; if relaxed to their "rest" condition, the initial force required to initiate compression of the springs is minimal, i.e., one need not press as hard against the exercise panel 30 with as much force to start it moving toward the back panel 25.

FIG. 4 shows how the apparatus may be folded into a collapsed storage position for portable transport and storage. To place the apparatus into the storage position, the shoulder straps 32, 32' are detached from the lower attachment points 47, 47' and their lower ends then reattached to opposite ones of the upper attachment points 46, 46', so that each shoulder strap extends between the two upper attachment points. The seat panel 20 is then pivoted from its use position, through approximately 270° to bring the seat panel 20 generally parallel to and closely spaced from the back panel 25, as seen in FIG. 4. With all three panels 20, 25, 30 arranged generally parallel, the apparatus is compact, and occupies a minimum amount of volume. With the apparatus so positioned, the seat attachment strap 22 and the back attachment strap 27 may be wrapped around all three juxtaposed panels 20, 25, and 30, and tightened and buckled in place. The chest straps 36, 36' are also wrapped under the attachment straps 22, 27, between the attachment straps and the seat pad 24. The attachment straps 22, 27 thus serve the extra function of temporarily holding the elements of the apparatus in the collapsed storage position seen in FIG. 4.

Figure 6C:
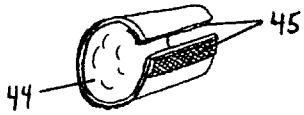
FIG. 6C is an enlarged view of the carry grip element of the apparatus.

As also depicted in FIG. 4, the shoulder straps 32, 32' and chest straps 36, 36' are drawn upward to serve as a handle from which the apparatus may be suspended and carried. An optional but desirable carry grip 44 is wrapped around the straps 32, 32', 36, 36' to collect and hold them together in the suspension handle configuration seen in FIG. 4. FIG. 6C illustrates that the carry grip is a flexible but durable, generally rectangular, swatch of fabric, plastic, ballistic nylon weave, or leather or the like. As seen in FIG. 4, the carry grip 44 may be reversibly secured in a tubular closed condition, to hold the straps 32, 32', 36, 36' together as carry handle, by means of complementary strips of VELCRO® brand fastener strips 45 (FIG. 6C), snaps, or similar suitable releasable fasteners. With the apparatus collected and held in the collapsed storage position seen in FIG. 4, the user may easily and comfortably grasp the carry grip 44 in the hand, and hanging the apparatus therefrom by the straps 32, 32', 36, 36', carry the apparatus as though it were a modest item of luggage.

Figure 5:
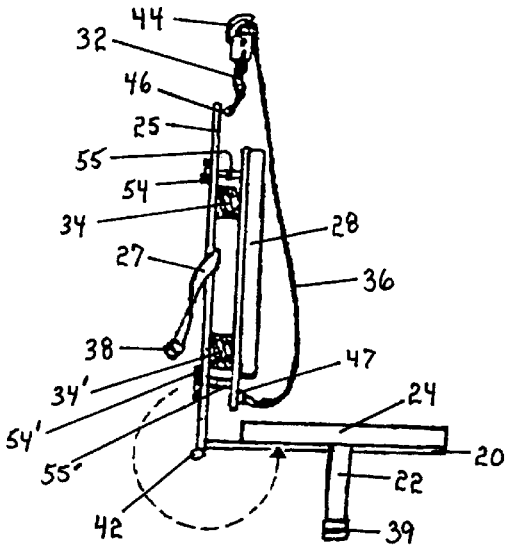
FIG. 5 is a reduced side view of the apparatus of the invention, showing how the apparatus may be unfolded to a use position.

The practice of the invention to plyometrically exercise the muscles of the back may now be described. The invention as configured in the closed storage position (FIG. 4) is removed to the location of use, such as a chair 10 upon the floor of an exercise room. The seat attachment strap 22 is loosened and its "free" ends detached from one another; the back attachment strap 27 likewise is loosened and detached. This allows the seat panel 20 to swing free from its position folded parallel against the back panel 25. The seat panel 20 is then swung through an arc of approximately 270° to a position about perpendicular to the back panel 25, as illustrated by the directional arrow in FIG. 5.

Combined reference is made to FIGS. 1–3. The apparatus is situated for use by temporarily but securely attaching it to the chair 10. The back panel 25 is attached to the back 12 of the chair by wrapping the segments of the back attachment strap 27 around the back of the chair, clinching or drawing them tightly together so that the strap 27 snugly grips the back of the chair, and then securing the strap using the buckle 38 or similar suitable fastener. The seat panel 20 is attached in like manner, using the seat attachment strap 22 and buckle 39. (The inventive apparatus can be removed from the chair 10 simply by releasing the buckles 38, 39.)

Figure 7:
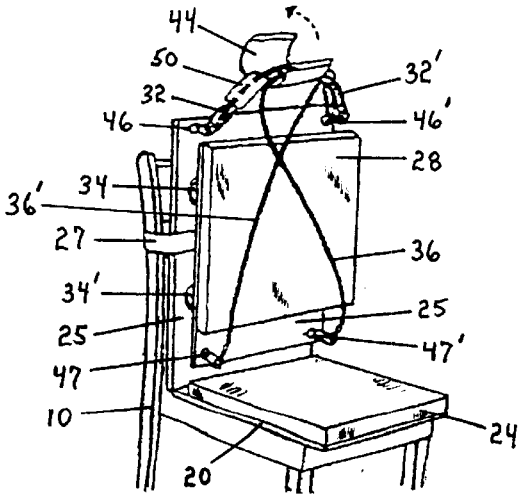
FIG. 7 is a reduced front perspective view of the apparatus of the invention, shown in a condition after being unfolded to the use position, showing how the straps are disposed prior to use.

The user then removes the carry grip 44 by disconnecting the fasteners 45. The removal of the carry grip 44 frees all the straps 32, 32', 36, 36', and the apparatus appears as seen in FIG. 7. One end of the left shoulder strap 32' is detached from the right upper attachment point 46 and is re-attached to the left lower attachment point 47' by means of a strap clip 52, so that the strap 32' extends from upper attachment point 46' to lower attachment point 47'. Similarly, an end of the right shoulder strap 32 is detached from the left upper attachment point 46' and is re-attached to the right lower attachment point 47 by means of a clip 52.

Figure 7A:
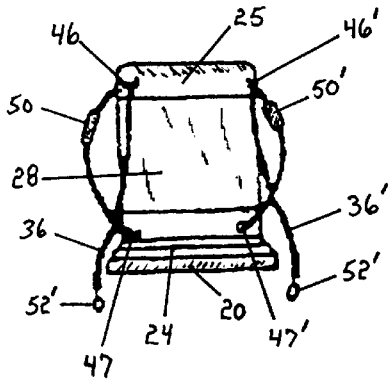
FIG. 7A is a reduced front view of the apparatus of the invention, shown in another position prior to use.

The lower ends of the chest straps 36, 36' are then detached from the lower attachment points 47, 47', so that the straps are configured as generally seen in FIG. 7A. The upper ends of the chest straps remain connected to the upper attachment points 46, 46'.

Figure 8A:
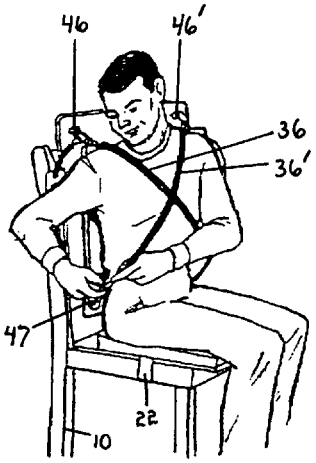
FIGS. 8A–8C illustrate how a user attaches himself to the apparatus and employs the apparatus to plyometrically exercise the muscles of his back.

The user then sits in the chair, placing his buttocks on the seat panel 20 and his back against the exercise panel 30. One chest strap 36' is drawn diagonally across the chest from left upper attachment point 46' to right lower attachment point 47, as seen in FIG. 8A, and its lower end is connected to the right lower attachment point by means of a clip 52. As also shown by FIG. 8A, the other chest strap 36 is drawn diagonally across the chest from right upper attachment point 46 down and over to the left lower attachment point 47', and there releasably is connected using a clip 52'.

Figure 8B:
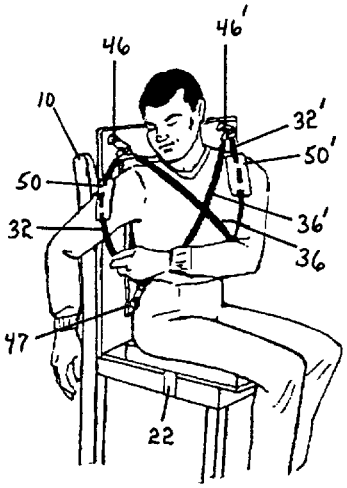

FIG. 8B shows that the user then slides his arms under the shoulder straps 32, 32', left arm under the left shoulder strap 32' and right arm under the right shoulder strap 32. The shoulder comfort cushions 50, 50' are adjusted into proper position to pad the user's shoulders.

Figure 8C:
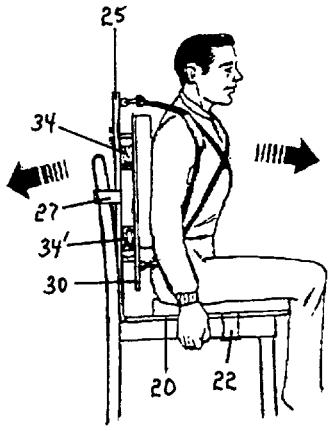

The benefits of the invention are then realized by the user's alternatively pushing back against the exercise panel 30, and then pulling forward against the straps 32, 32', 36, 36', as seen in FIG. 8C and suggested by the directional arrows therein. The user exercises his back muscles by quickly and explosively pressing his back against the exercise panel 30 to compress the springs 34, 34', which will immediately offer a resilient resistance to the action. The "tighter" the adjustment handles 54, 54' are adjusted, the harder the user finds it to compress the exercise panel 30 toward the back panel 25 (whose position is fixed). AS soon as the user has compressed the springs 34, 34' to the maximum extent possible by rapid action of the back muscles, he then begins the forward motion by pressing forward against the straps 32, 32', 36, 36'. The back muscles accordingly must quickly and explosively pull the exercise panel 30 away from the back panel 25 against the tension of the now-extended springs 34, 34'. Because the lower attachment points 47, 47' are upon the exercise panel, the user's effort to rapidly pull and then push against the exercise panel results in a plyometric workout of the lower back muscles.

In keeping with the philosophy of plyometric exercise, it is not contemplated that the apparatus be used in a slow mode. Rather, the proper use is by a rapid to-and-from motion of the user's torso, whereby the exercise panel 30 is rapidly alternately pressed toward the back panel 25, and then immediately pulled away from the back panel. This reciprocating motion is continued for as long as the user cares to, according to his planned exercise regimen.

Notably, only when the user is at rest are the springs 34, 34' also at rest. Any movement of the user's torso backward (i.e. to press the exercise panel 30 against the compressive force of the springs), or forward (i.e. to push against the straps 32, 32', 36, 36' and thereby pull against the tension of the springs) necessarily results in a plyometric workout of the back muscles. Repeated quickly and rapidly, such motions provide beneficial exercise to the muscles of the user's back.

Upon completion of an exercise session, the user may release the straps 32, 32', 36, 36' by opening any appropriate pairs of clips 52, 52', and rising from the chair 10. If desired, the apparatus may be removed from the chair by releasing the attachment straps 22 and 27, and the apparatus folded to the closed position seen in FIG. 4 for storage.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An apparatus for plyometrically exercising the muscles of the user's back, said apparatus comprising:

a rigid seat panel;

a rigid back panel connected to said seat panel and disposable approximately perpendicular to said seat panel;

an exercise panel disposed generally parallel to said back panel;

means for pivotally connecting said seat panel to said back panel;

spring means for movably connecting said exercise panel to said back panel; and at least one body strap connected to said exercise panel; wherein the user may sit upon said seat panel with the user's back in contact with said exercise panel and with said at least one body strap disposed around the torso of the user, and wherein further the user may repeatedly and alternately push against the exercise panel and the force of said spring means, and pull against said at least one body strap and the force of said spring means, thereby to plyometically exercise the muscles of the users back.

2. An apparatus according to claim 1 further comprising a seat pad upon said seat panel.

3. An apparatus according to claim 1 further comprising a back pad upon said exercise panel.

4. An apparatus according to claim 1, wherein said means for pivotally connecting comprises a hinge, whereby said seat panel is pivotal between a use position approximately perpendicular to said back panel and a storage position approximately,parallel to said back panel.

5. An apparatus according to claim 1 wherein said spring means comprises at least one helical coil spring mounted between said back panel and said exercise panel.

6. An apparatus according to claim 5 wherein said spring means comprises a plurality of helical coil springs disposed symmetrically about the centroids of said back and exercise panels.

7. An apparatus according to claim 5 further comprising means for adjusting the impression of said at least one helical coil spring.

8. An apparatus according to claim 7 wherein said means for adjusting compression comprises:

at least one threaded adjustment bolt mounted upon said exercise panel and extending through said back panel; and an adjustment knob screwably engaged to said at least one threaded adjustment bolt and contactable with said back panel, wherein rotation of said knob moves said back panel to vary the distance between said back panel and said exercise panel thereby to adjust the compression of said at least one coil spring.

9. An apparatus according to claim 1 comprising at least one back attachment strap connected to said back panel, wherein said back attachment strap is removably engageable around the back of a chair to secure said back panel to the chair.

10. An apparatus according to claim 1 comprising at least one seat attachment strap connected to said seat panel, wherein said seat attachment strap is removably engageable around the seat of a chair to secure said seat panel to the chair.

11. An apparatus according to claim 1 wherein said at least one body strap comprises a pair of shoulder straps, each of said straps having an upper end removably attachable to an upper portion of said exercise panel and a lower end removably attachable to a lower portion of said exercise panel.

12. An apparatus according to claim 1 wherein said at least one body strap comprises a pair of chest straps, each of said straps having an upper end removably attachable to an upper portion of said exercise panel and a lower end removably attachable to a lower portion of said exercise panel.

13. An apparatus for plyometrically exercising the muscles of the user's back, said apparatus comprising:

a rigid seat panel;

a rigid back panel connected to said seat panel and disposable approximately perpendicular to said seat panel;

an exercise panel disposed generally parallel to said back panel;

a plurality of helical coil springs mounted between and connecting said exercise panel to said back panel, and disposed symmetrically about the centroids of said back and exercise panels, wherein said exercise panel is movable in relation to said back panel; and at least one body strap connected to said exercise panel; wherein the user may sit upon said seat panel with the user's back in contact with said exercise panel and with said at least one body strap disposed around the torso of the user, and wherein further the user may repeatedly and rapidly alternately push against the exercise panel and the force of said at least one spring, and pull against said at least one body strap and the force of said at least one spring, thereby to plyometrically exercise the muscles of the user's back.

14. An apparatus according to claim 13 further comprising at least one back attachment strap connected to said back panel, wherein said back attachment strap is removably engageable around the back of a chair to secure said back panel to the chair.

15. An apparatus according to claim 14 further comprising at least one seat attachment strap connected to said seat panel, wherein said seat attachment strap is removably engageable around the seat of a chair to secure said seat panel to the chair.

16. An apparatus according to claim 15 further comprising means for pivotally connecting said seat panel to said back panel, said means for pivotally connecting comprising at least one hinge, whereby said seat panel is pivotal between a use position approximately perpendicular to said back panel and a storage position approximately parallel to said back panel.

17. An apparatus according to claim 16 wherein when said seat panel is in the stored position, said back attachment strap is engageable around said seat panel, and said seat attachment strap is engageable around said back panel, thereby to hold said seat panel in the stored position.

18. An apparatus according to claim 13 further comprising means for adjusting the compression of said helical, coil springs.

19. An apparatus according to claim 18 wherein said means for adjusting compression comprises:

at least one threaded adjustment bolt mounted upon said exercise panel and extending through said back panel; and an adjustment knob screwably engaged to said at least one threaded adjustment bolt and contactable with said back panel, wherein rotation of said knob moves said back panel to vary the distance between said back panel and said exercise panel thereby to adjust the compression of said at least one coil spring.

20. An apparatus according to claim 19 wherein said at least one body strap comprises a pair of shoulder straps, each of said straps having an upper end removably attachable to an upper portion of said exercise panel and a lower end removably attachable to a lower portion of said exercise panel.

21. An apparatus according to claim 20 wherein said at least one body strap further comprises a pair of chest straps, each of said straps having an upper end removably attachable to an upper portion of said exercise panel and a lower end removably attachable to a lower portion of said exercise panel.

* * * * *